US006413056B1

(12) United States Patent
Chou

(10) Patent No.: US 6,413,056 B1
(45) Date of Patent: Jul. 2, 2002

(54) AIR COMPRESSOR HAVING MEANS TO SELECTIVELY CONTROL AIR FLOW THEREIN

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 0 days.

(21) Appl. No.: 09/737,728

(22) Filed: Dec. 18, 2000

(51) Int. Cl.[7] ..... F04B 35/04; F01D 3/02; F01B 25/02

(52) U.S. Cl. ..... 417/366; 417/371; 417/423.14; 415/98; 415/151; 415/167

(58) Field of Search ..... 417/423.14, 295, 417/238, 239, 366, 371, 423.1; 415/206, 151, 98, 157, 167

(56) References Cited

U.S. PATENT DOCUMENTS 3,457,868 A * 7/1969 Eaton ..... 415/151
4,289,457 A * 9/1981 Porter ..... 415/157
4,999,036 A 3/1991 Hwang et al. ..... 55/317
5,110,266 A * 5/1992 Toyoshima et al. .... 417/423.14
6,295,693 B1 * 10/2001 Chou ..... 15/330

* cited by examiner

*Primary Examiner*—Charles G. Freay
(74) *Attorney, Agent, or Firm*—Charles E. Baxley

(57) ABSTRACT

An air compressor includes a housing having a port formed in a motor casing and another port formed in a fan casing. The fan casing has a mouth for air to flow into the housing. The mouth may be selectively blocked for facilitating the drawing of the air into the housing via the ports. The fan device includes a plate having two sides and having one or more blades extended from each of the sides of the plate for facilitating the air circulating or paddling or drawing effect of the air compressor. The blade is preferably extended radially and laterally relative to the plate.

16 Claims, 8 Drawing Sheets

AIR COMPRESSOR HAVING MEANS TO SELECTIVELY CONTROL AIR FLOW THEREIN

BACKGROUND OF THE INVENTION

1. Field of the Invention

The present invention relates to an air compressor, and more particularly to an air compressor having one or more nozzles that may be easily attached to or detached from the air compressor for various kinds of uses and having an improved fan device.

2. Description of the Prior Art

Typical air compressors comprise a fan rotatably received in a housing and driven by a motor for drawing air into the housing and for generating a pressurized air to inflate the tires air beds or air cushions, hovercrafts, etc. One of the typical air compressors is disclosed in U.S. Pat. No. 4.999.036 to Hwang et al., and comprise an air inlet for allowing the air to flow into the housing. and an air outlet for supplying the pressurized air to the air devices that are required to be inflated. The fan device includes the blades provided on one side of the fan device only such that the air circulating effect thereof is bad. The typical air compressors may not be used to discharge or to release the air in the air devices. In addition, the typical air compressors do not have various kinds of nozzles for engaging with the various kinds of air devices.

The present invention has arisen to mitigate and/or obviate the afore-described disadvantages of the conventional air compressors.

SUMMARY OF THE INVENTION

The primary objective of the present invention is to provide an air compressor including one or more nozzles for being selectively attached to the air compressor and to selectively couple the air compressor to various kinds of air devices for inflating the air devices.

The other objective of the present invention is to provide an air compressor including one or more nozzles for being selectively attached to the air compressor and for discharging or releasing the air from the air devices.

The further objective of the present invention is to provide an air compressor including an improved fan device for facilitating the air circulating effect of the air compressor.

In accordance with one aspect of the invention, there is provided an air compressor comprising a housing including a fan casing and a motor casing, the fan casing including a first port and a mouth provided therein, the motor casing including a second port provided therein, a motor received in the motor casing, a fan device received in the fan casing and coupled to the motor for being driven by the motor, and means for selectively blocking the mouth of the fan casing to control an air flow through the mouth.

The selectively blocking means includes a cover for selectively engaged with the mouth and for selectively blocking the mouth. The mouth includes a protrusion extended therefrom, the cover includes an orifice formed therein for receiving the protrusion of the mouth and for blocking the mouth.

The mouth includes at least one hole formed therein, the cover is selectively engaged with the mouth to selectively block the hole of the mouth. The mouth includes a peripheral wall provided therein, and limiting means for limiting a relative movement between the cover and the peripheral wall of the mouth.

The limiting means includes a peripheral flange extended radially outward of the peripheral wall of the mouth, and a peripheral rib extended radially inward of the cover and engaged with the peripheral flange of the peripheral wall for limiting the relative movement between the cover and the peripheral wall of the mouth.

The fan device includes a plate having two sides and having at least one blade extended from each of the sides of the plate for facilitating the air circulating or air paddling effect of the fan device. The blade is preferably extended radially relative to the plate and extended laterally outward of the plate.

One or more nozzles may further be provided and selectively engaged onto the first port and the second port of the housing for coupling the ports of the housing to the other air devices or air facilities.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
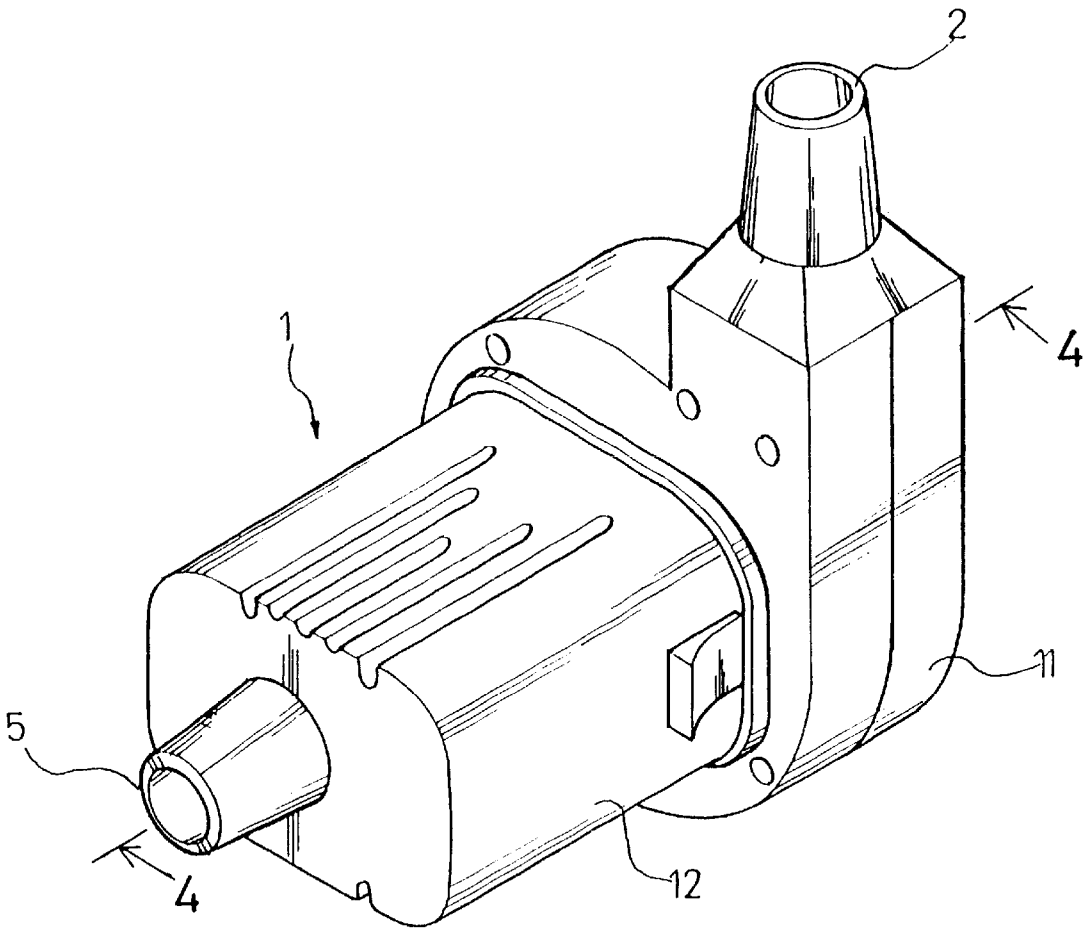
FIG. 1 is a perspective view of an air compressor in accordance with the present invention.

Referring to the drawings, and initially to FIGS. 1–7, an air compressor in accordance with the present invention comprises a housing I having a fan casing 11 and a motor casing 12, for receiving a paddle or a fan device 6 and a motor 13 respectively. The fan device 6 is secured to the spindle 14 of the motor 13 such that the fan device 6 may be powered or driven by the motor 13 for drawing air into the housing 1 and for generating a pressurized air to pump the other air devices or air facilities. As best shown in FIGS. 4–7, the fan device 6 includes a plate 61 which is preferably circular and which includes a number of fins or blades 62 laterally extended outward from the plate 61 and arranged or extended radially relative to the plate 61.

The housing 1 includes a mouth 3 formed on the fan casing 11 and facing toward one side of the fan device 6 for allowing the air to flow into the housing 1, and includes a port 2 formed on the fan casing 11 for receiving and supplying the pressurized air in the housing 1 or generated by the motor driven fan device 6 out to the other air devices or air facilities, and includes another port 5 formed on the motor casing 12 for coupling to the other air devices or the air facilities and for discharging or sucking or releasing the air out of the other air devices or air facilities. The ports 2, 5 of the housing 1 are substantially cylindrical and formed on the fan casing 11 and the motor casing 13 respectively for allowing the air to flow in and out of the housing 1. It is preferable that the ports 2, 5 each includes a narrower free end portion and a wider or greater root portion.

Figure 2:
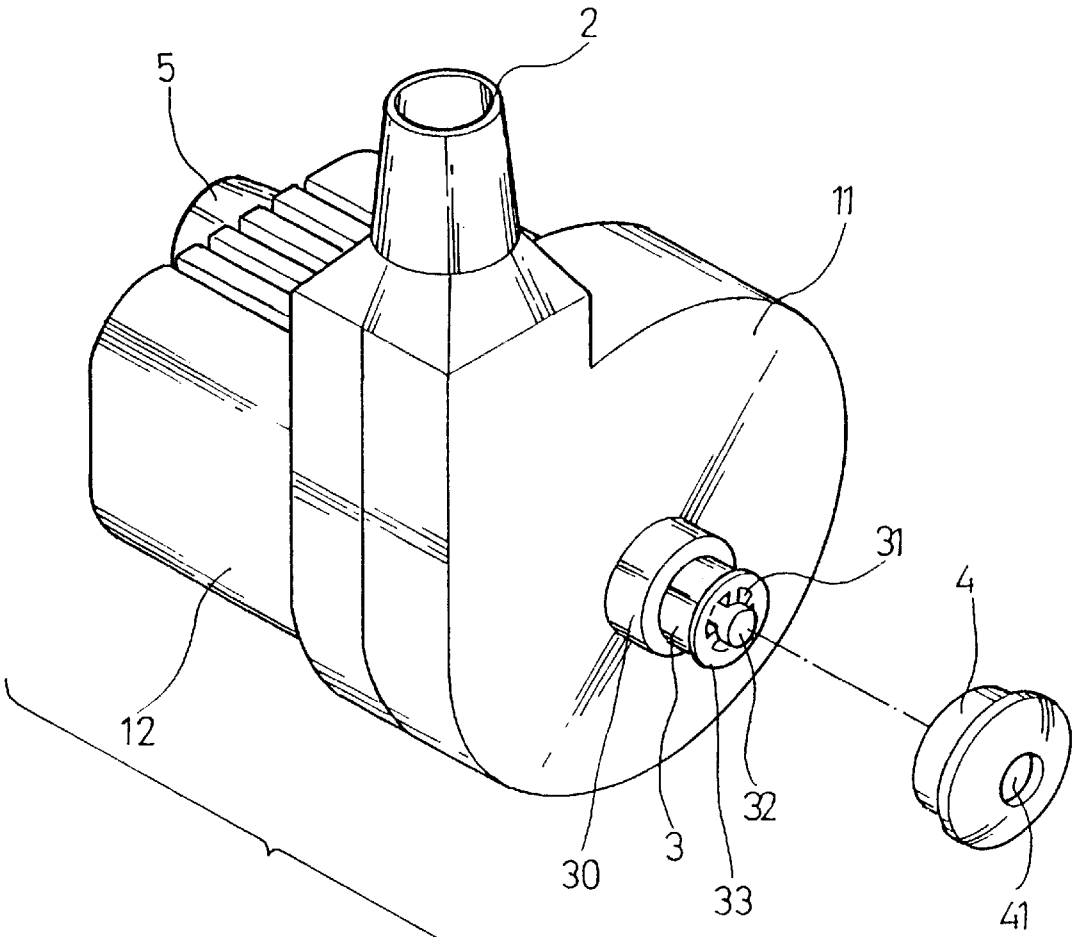
FIGS. 2, 3 are partial exploded views illustrating an air compressor having one or more nozzles for selectively attaching to the air compressor.
Figure 3:
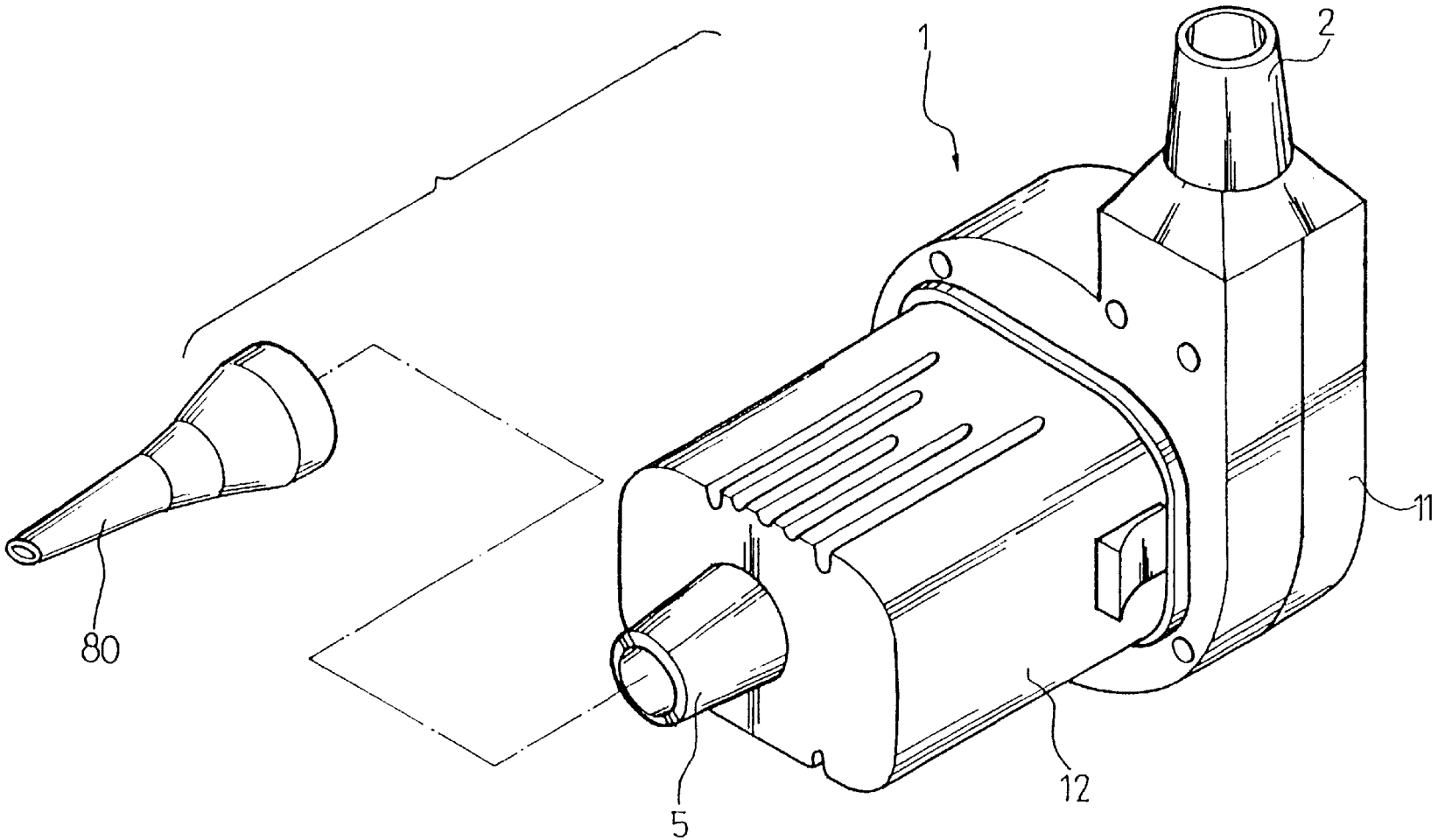
Figure 4:
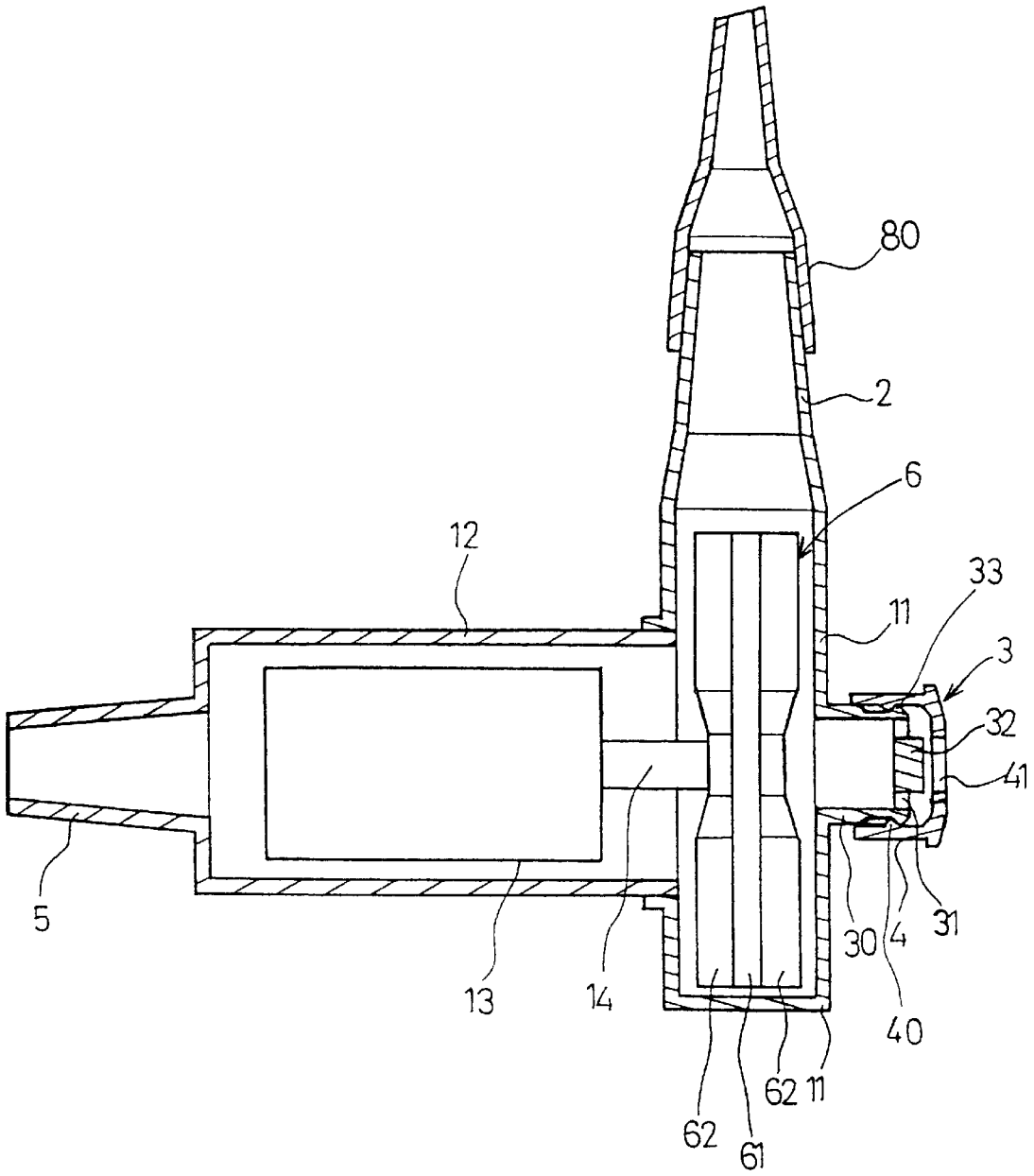
FIGS. 4 and 5 are cross sectional views taken along lines 4—4 of FIG. 1, illustrating the selectively attachments or engagements of the nozzle to the ports of the air compressor.
Figure 5:
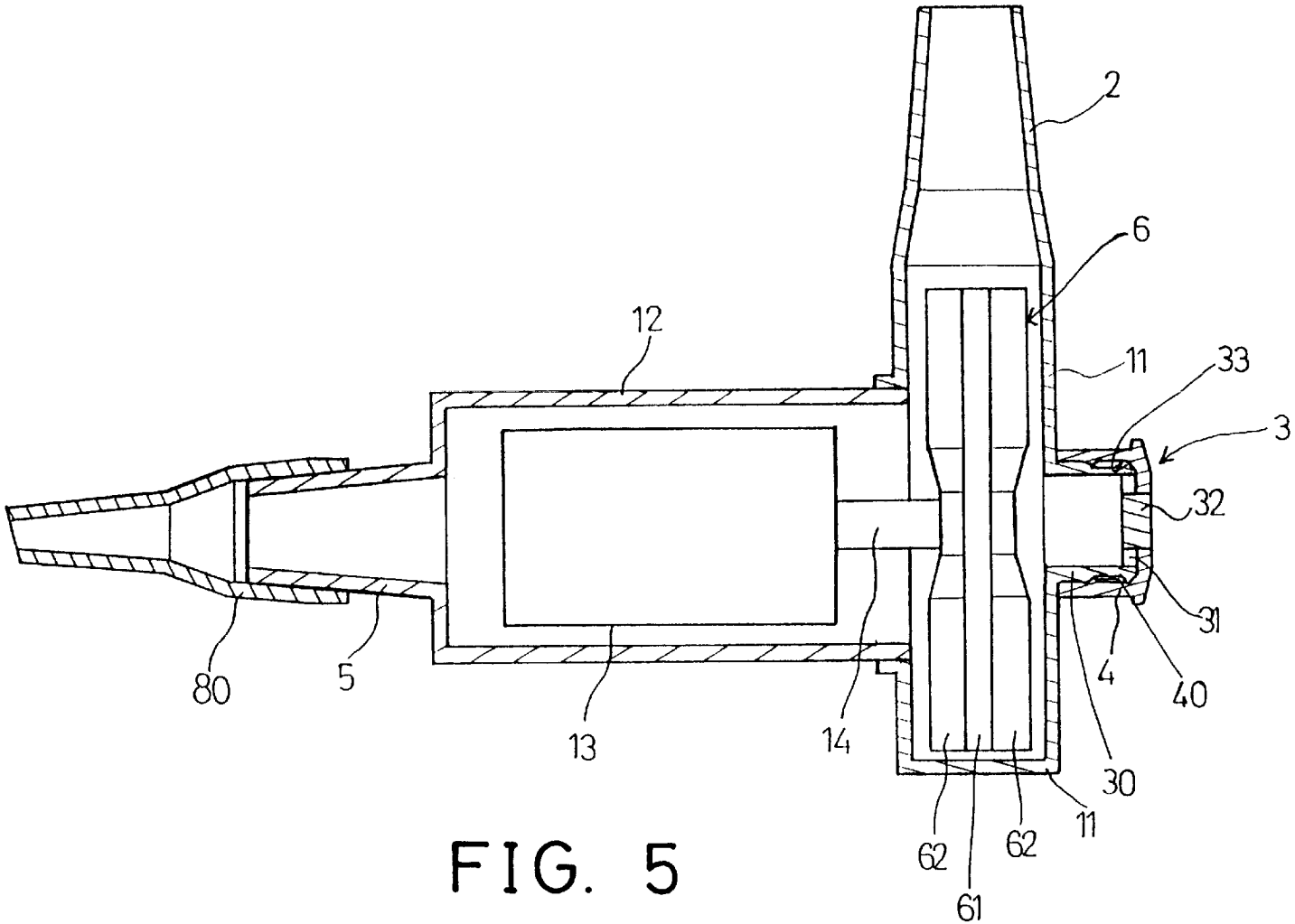
Figure 6:
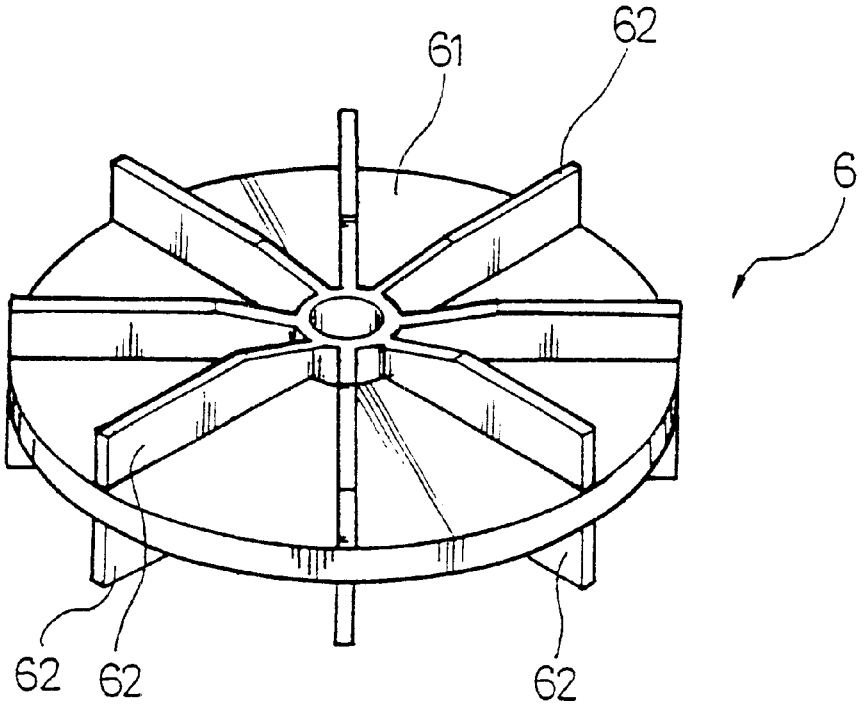
FIG. 6 is a perspective view of a fan device for the air compressor.
Figure 7:
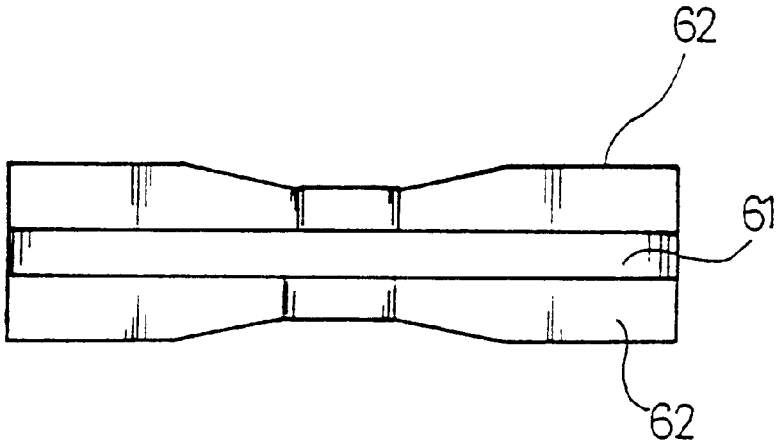
FIG. 7 is a plane view of the fan device.

Referring particularly to FIGS. 2, 4 and 5, the mouth 3 includes a peripheral wall 30 having one or more holes 31 formed and provided therein for the air to flow into the housing 1, and includes a protrusion 32 extended outward therefrom, particularly extended outward from the center portion of the peripheral wall 30, and includes a peripheral flange 33 extended radially outward from the free end portion of the peripheral wall 30. The protrusion 32 is further extended outward beyond the peripheral flange 33.

A cover 4 is slidably engaged onto the peripheral wall 30 and includes a peripheral rib 40 extended radially inward therefrom for engaging with the peripheral flange 33 of the peripheral wall 30 and for limiting the relative movement between the cover 4 and the peripheral wall 30, and for preventing the cover 4 from being disengaged from the mouth 3 of the housing 1. The cover 4 includes an orifice 41 formed therein for receiving the protrusion 32 with such as a force-fitted engagement or an air tight seal. When the cover 4 is forced toward the peripheral wall 30 to engage the protrusion 32 into the orifice 41 of the cover 4, the holes 31 of the mouth 3 may be blocked (FIG. 5), such that the air may not flow into the housing I via the mouth 3. As shown in FIG. 4, when the orifice 41 of the cover 4 is disengaged from the protrusion 32, the air is allowed to flow into the housing 1 via the orifice 41 of the cover 4 and the holes 31 of the mouth 3.

Figure 8:
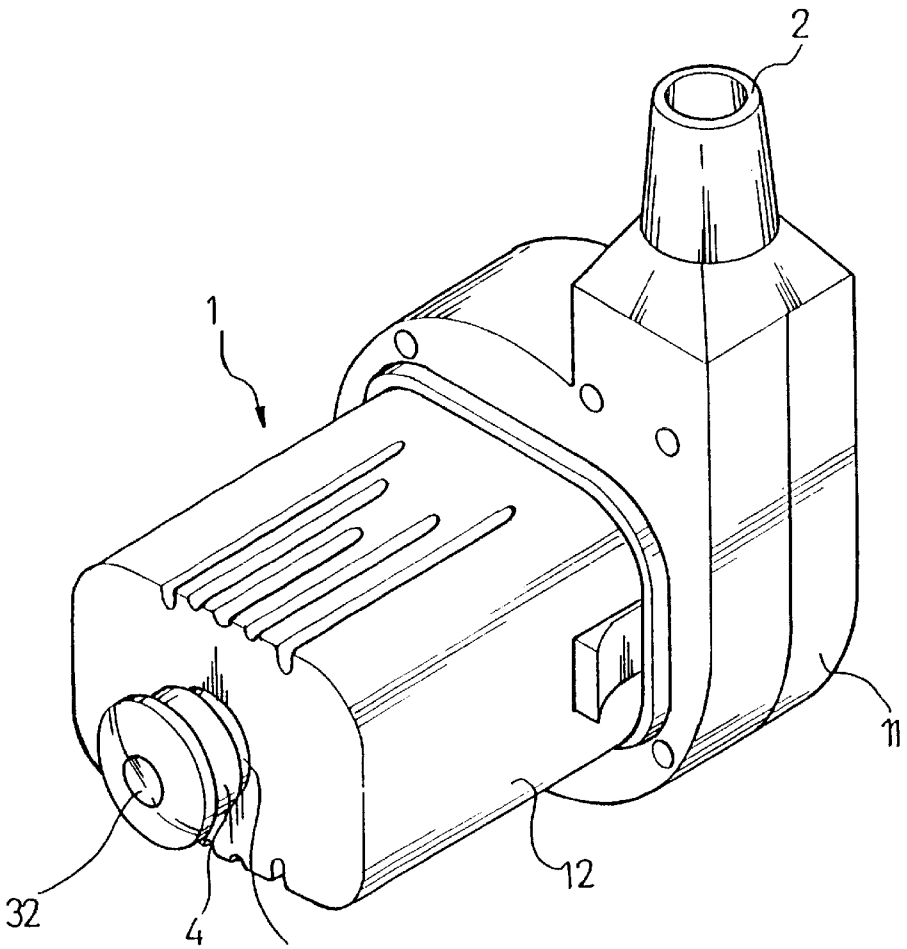
FIGS. 8 and 9 are perspective views illustrating the other application of the air compressor.
Figure 9:
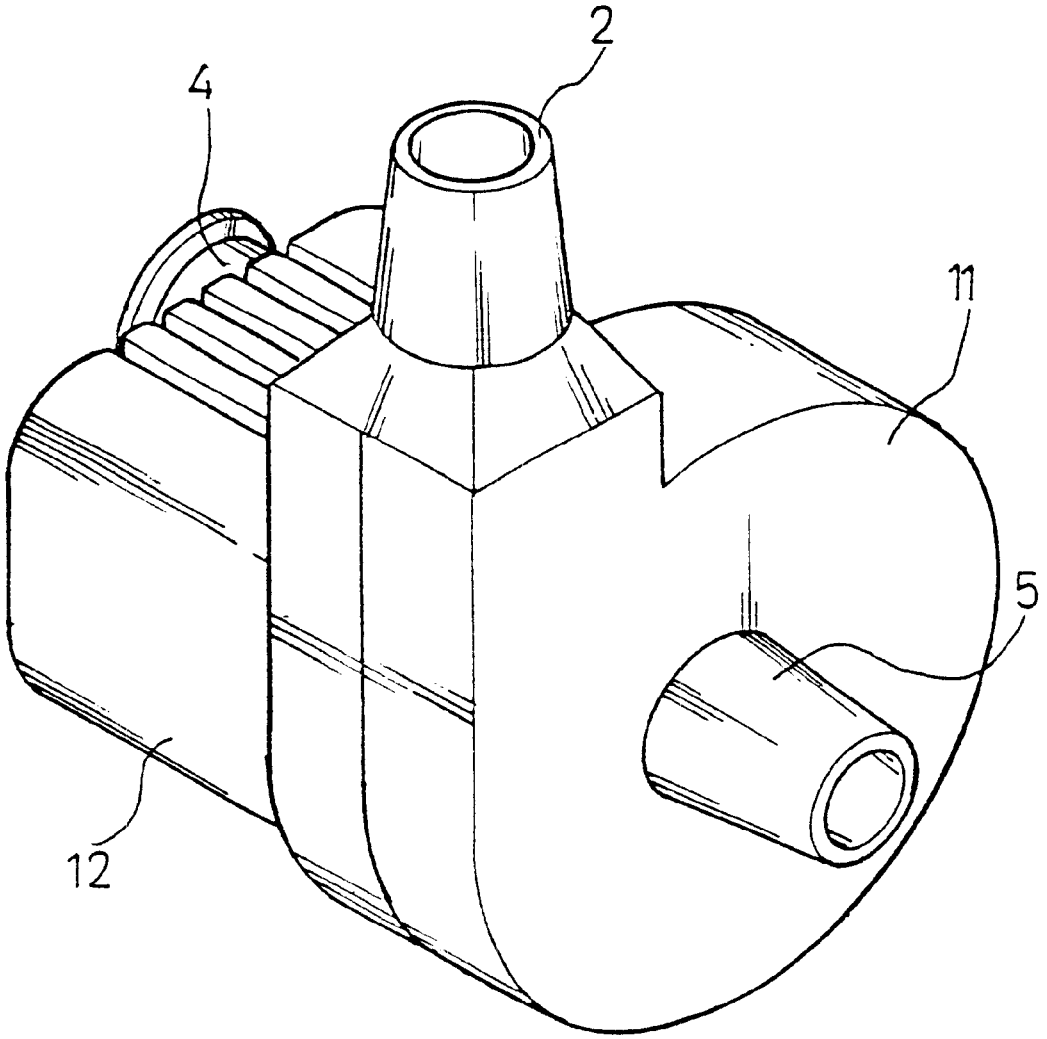

Alternatively, as shown in FIGS. 8, 9, the mouth 3 and the cover 4 may be provided in the motor casing 12 (FIG. 8) instead of being provided in the fan casing 11 (FIGS. 2, 4, 5).

One or more nozzles 80 may be selectively engaged onto the respective ports 2 (FIG. 4) or 5 (FIG. 5) with such as a force-fitted engagement, for coupling the ports 2 and/or 5 to various kinds of air devices or air facilities.

In operation, the nozzles 80 may be easily and quickly attached onto the port 2 and/or the port 5 for selectively coupling to the air devices. For example, the nozzle 80 attached to the port 2 may be coupled to the selected air devices for supplying the pressurized air to pressurize or to inflate the air devices. The nozzle 80 attached to the port 5 may be coupled to the selected air devices for discharging or releasing the air from or out of the air devices. The cover 4 is preferably forced to block the holes 31 of the mouth 3 (FIG. 5) when the port 5 is coupled to the air devices to discharge or release the air from the air devices, in order to facilitate the air suction or discharging of the air from the air devices.

The fan device having the fan blades 62 extended from both sides of the plate 61 may facilitate the flowing of the air through the mouth 3 and the ports 2, 5 and may thus facilitate the air circulating effect of the air compressor.

Accordingly, the air compressor in accordance with the present invention includes an air compressor having one or more nozzles for selectively attached to the air compressor and to selectively couple the air compressor to various kinds of air devices for inflating the air devices. The nozzles may also be used for selectively discharging or releasing the air from the air devices. The fan device has an improved configuration for facilitating the air circulating effect of the air compressor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a housing including a fan casing and a motor casing, said fan casing including a first port and a mouth provided therein, said motor casing including a second port provided therein, a motor received in said motor casing, a fan device received in said fan casing and coupled to said motor for being driven by said motor, and means for selectively blocking said mouth of said fan casing to control an air flow through said mouth, said selectively blocking means including a cover for selectively engaging said mouth and for selectively blocking said mouth.

2. The air compressor according to claim 1, wherein said mouth includes a protrusion extended therefrom, said cover includes an orifice formed therein for receiving said protrusion of said mouth and for blocking said mouth.

3. The air compressor according to claim 1, wherein said mouth includes at least one hole formed therein, said cover is selectively engaged with said mouth to selectively block said at least one hole of said mouth.

4. The air compressor according to claim 1, wherein said mouth includes a peripheral wall provided therein, and limiting means for limiting a relative movement between said cover and said peripheral wall of said mouth.

5. The air compressor according to claim 4, wherein said limiting means includes a peripheral flange extended radially outward of said peripheral wall of said mouth, and a peripheral rib extended radially inward of said cover and engaged with said peripheral flange of said peripheral wall for limiting the relative movement between said cover and said peripheral wall of said mouth.

6. The air compressor according to claim 1, wherein said fan device includes a plate having two sides and having at least one blade extended from each of said sides of said plate.

7. The air compressor according to claim 6, wherein said at least one blade is extended radially relative to said plate and extended laterally outward of said plate.

8. An air compressor comprising:

a housing including a fan casing and a motor casing, said fan casing including a first port and a mouth provided therein, said motor casing including a second port provided therein, a motor received in said motor casing, a fan device received in said fan casing and coupled to said motor for being driven by said motor, means for selectively blocking said mouth of said fan casing to control an air flow through said mouth, and at least one nozzle selectively engaged onto said first port of said fan casing and said second port of said motor casing.

9. An air compressor comprising:

a housing, a motor received in said housing, a fan device received in said housing and coupled to said motor for being driven by said motor, wherein said fan device includes a plate having two sides and having at least one blade extended from each of said sides of said plate for facilitating an air circulating effect to said air compressor, said housing including a fan casing for receiving said fan device and having a first port and a mouth provided therein, and said housing including a motor casing for receiving said motor and having a second provided therein, and at least one nozzle selectively engaged onto said first port of said fan casing and said second port of said motor casing.

10. The air compressor according to claim 9, wherein said at least one blade is extended radially relative to said plate and extended laterally outward of said plate.

11. The air compressor according to claim 9 further comprising means for selectively blocking said mouth of said fan casing to control an air flow through said mouth.

12. An air compressor comprising:

a housing, a motor received in said housing, a fan device received in said housing and coupled to said motor for being driven by said motor, wherein said fan device includes a plate having two sides and having at least one blade extended from each of said sides of said plate for facilitating an air circulating effect to said air compressor, said housing including a fan casing for receiving said fan device and having a first port and a mouth provided therein, and includes a motor casing for receiving said motor and having a second port provided therein, and means for selectively blocking said mouth of said fan casing to control an air flow through said mouth, said selectively blocking means including a cover for selectively engaging said mouth and for selectively blocking said mouth.

13. The air compressor according to claim 12, wherein said mouth includes a protrusion extended therefrom, said cover includes an orifice formed therein for receiving said protrusion of said mouth and for blocking said mouth.

14. The air compressor according to claim 12, wherein said mouth includes at least one hole formed therein, said cover is selectively engaged with said mouth to selectively block said at least one hole of said mouth.

15. The air compressor according to claim 12, wherein said mouth includes a peripheral wall provided therein, and limiting means for limiting a relative movement between said cover and said peripheral wall of said mouth.

16. The air compressor according to claim 15, wherein said limiting means includes a peripheral flange extended radially outward of said peripheral wall of said mouth, and a peripheral rib extended radially inward of said cover and engaged with said peripheral flange of said peripheral wall for limiting the relative movement between said cover and said peripheral wall of said mouth.

* * * * *